US006076296A

United States Patent [19]

Schaeffer

[11] Patent Number: 6,076,296

[45] Date of Patent: Jun. 20, 2000

[54] COMBINED HOLDER AND HANDLE FOR MACHINE READABLE ENTRY CARD

[76] Inventor: Robert Schaeffer, 235 E. 87th St., #3L, New York, N.Y. 10128

[21] Appl. No.: 09/197,147

[22] Filed: Nov. 20, 1998

[51] Int. Cl.[7] ..... G09F 3/18; G09F 3/20

[52] U.S. Cl. ..... 40/661.12; 40/661.08; 40/661.04; 40/649; 40/654.01; 40/658

[58] Field of Search ..... 40/661.08, 661.04, 40/649, 654.01, 658, 666, 642.02, 661.12

[56] References Cited

U.S. PATENT DOCUMENTS

| | | | |
|---|---|---|---|
| 2,035,789 | 7/1936 | Collins | 40/1.5 |
| 2,717,463 | 9/1955 | Sindler | 40/11 |
| 3,263,352 | 8/1966 | Fitzpatrick | 40/10 |
| 3,283,421 | 11/1966 | Schott | 434/415 |
| 3,553,864 | 1/1971 | Karlyn et al. | 40/661.08 X |
| 3,553,865 | 1/1971 | Jones | 40/643 |
| 3,727,333 | 4/1973 | Ward et al. | 40/661.04 |
| 4,209,925 | 7/1980 | Brugmann | 40/359 |
| 4,240,543 | 12/1980 | McKee | 206/39 |
| 4,389,755 | 6/1983 | Villa-Real | 24/67.9 |
| 4,462,175 | 7/1984 | Romberger | 40/661 |
| 5,156,898 | 10/1992 | McDonald | 428/100 |
| 5,388,739 | 2/1995 | Gargan | 40/586 X |
| 5,406,726 | 4/1995 | Fan | 40/1.6 |
| 5,592,767 | 1/1997 | Treske | 40/649 |
| 5,769,213 | 6/1998 | Chatterton | 206/38 |

OTHER PUBLICATIONS

Photocopy of "MetroCardin" Holder Author + Date Unknown But Believed Prior.

Sample of Combined Card Holder and Transit Map Re 5156898.

*Primary Examiner*—Terry Lee Melius
*Assistant Examiner*—Rodrigo J. Morales
*Attorney, Agent, or Firm*—Robert W. J. Usher

[57] ABSTRACT

A card holder for a mass transit entry card having one longitudinal edge portion encoded with machine readable information is formed by folding a plastic blank to provide overlying panel portions forming a pocket which clasps the opposite longitudinal edge portion of the card adjacent the fold so that the encoded edge extends clear of the holder, remote from the fold exposed for machine reading by longitudinal sliding movement along a slot of a card reading head in a swiping action. A hook extends in coplanar relation from a longitudinal end of one of the panel portions for securing the card holder carrying the card to a user's bag strap or pocket and has a returned free end extending inward, behind a land which extends from the panel portion, forming a stop, preventing overstress of the hook.

18 Claims, 2 Drawing Sheets

COMBINED HOLDER AND HANDLE FOR MACHINE READABLE ENTRY CARD

FIELD OF THE INVENTION

The invention relates to a card holder for a machine readable entry card having securement means for releasable attachment to the user and which provides a handle for passing the card through a reader so that the card can be read while still held by the holder.

BACKGROUND OF THE INVENTION

In addition to the ubiquitous bank credit cards, in recent years, the use of subway entry cards known as a METROCARD $_{SM}$ has become widespread, particularly in New York City mass transport system. Such subway entry cards are similar in shape to conventional bank cards but thinner and more flexible and have a strip portion magnetically encoded with information such as residual value, expiry date, etc., extending along one longitudinal edge portion. In use, the longitudinal edge portion carrying the encoded strip portion is inserted into a slot of a reading head at the turnstile and slid (swiped) therealong by a user clasping the opposite longitudinal edge portion of the card.

Commuters usually need to make the card available for use to enter the subway at least twice, and often, as many as four or more times each day during their daily commute, but must also carry the card securely on their person at all other times as, apart from the time consuming inconvenience of loss, requiring a purchase at crowded peak times, the card does not identify the purchaser and, consequently, no refund of the, often substantial, residual card value can be obtained.

In recognition of the need to carry the card securely on the person, a small aperture for receiving a security chain or ring is formed in the card at a location spaced inwardly of the magnetic strip. However, in practice, the presence of the chain or ring often obstructs full entry and movement of the card along the slot of the reading head so that the inconvenience of removing the card from the chain or ring and reattachment thereto immediately before and after each use remains.

An additional card handling problem arises from the thinness and flexibility of the card which can lead to difficulties in removal from flat pockets of conventional flat sleeve or frame type holders. In one proposed solution, a commercial holder dedicated to the METROCARD $_{SM}$ provides a protective card receiving sleeve or frame-form pocket formed with an extended thumb receiving notch through which a user's thumb can engage the face of the card to facilitate sliding withdrawal from the pocket. Another commercial holder taught by U.S. Pat. No. 5,156,898 and dedicated to the METROCARD $_{SM}$ provides a flat, card receiving pocket having a system map attached thereto.

However, both of the latter two proposals incur the inconvenience of requiring complete removal of the card from the holder each time of use while neither provides for securement of the holder to the person.

Other holders are taught by U.S. Pat. No. 5,592,767 issued January 1997 to Treske and U.S. Pat. No. 4,240,543 issued 1980 to McKee but those are for displaying identification cards or documents. Although both have some form of releasable attachment means they also teach containment of the entire card or paper wholly within the holder and are not suitable for the purpose of the present invention.

U.S. Pat. No. 3,263,352 issued to Fitzpatrick in 1964 teaches a holder for outgoing mail while protecting against inclement weather, and is clearly unsuitable for the purpose of the invention.

SUMMARY OF THE INVENTION

It is an object of the invention to provide a card holder for a machine readable card which is adapted to be carried releasably secured to the person and which provides a handle for passing the card through a reader so that the card can be read without removal from the holder.

It is a further object of the invention to provide such card holder which is of extremely compact and simple construction for convenient carrying on the person and economical manufacture by conventional mass production techniques.

According to one aspect of the invention, the card holder comprises a card receiving pocket for retaining the card with the encoded edge portion thereof protruding out of the pocket clear of the holder, thereby exposed, for free insertion in a slot of a reading head of a card reader by a person gripping the card holder, enabling the card to be read without removal from the card holder and, releasable securing means attached to the pocket for securing the card holder retaining the card to one of a user's pocket and bag strap.

Preferably, the card receiving pocket comprises two rectangular panel portions having adjacent side edges joined together along only one side, so that the panel portions extend in parallel, overlying relation for retaining a card between them with the encoded edge portion protruding out from an opposite side of the pocket remote from said side edges.

It is further preferred that the releasable securing means comprises a hook integrally formed with the card receiving pocket and extends in substantially coplanar relation from one of the panel portions and that the two panel portions are joined together only along one pair of adjacent sides and grip the card between them. As the other three edges are free the precise longitudinal positioning of a card received in the pocket is not critical provided that it does not interfere with the hooking function.

It is also preferred that the hook extends in substantially coplanar relation from a longitudinal end of one of the panel portions and the two panel portions are formed by folding a blank about a longitudinal axis providing a hinge by which the adjacent side edges are joined together. This structure enables the card holder to be formed in one piece from a blank without obstruction of the hook obviating any requirement for bonding/gluing operations.

In a particular example, a returned free end of the hook extends inward, behind a land which extends from the panel portion and forms a stop, preventing overstress of the hook.

BRIEF DESCRIPTION OF THE DRAWINGS

In order that the invention may be readily understood, specific embodiments of an entry card holder for a machine readable card will now be described with reference to the accompanying drawings in which.

DESCRIPTION OF PARTICULAR EMBODIMENTS

Figure 1:
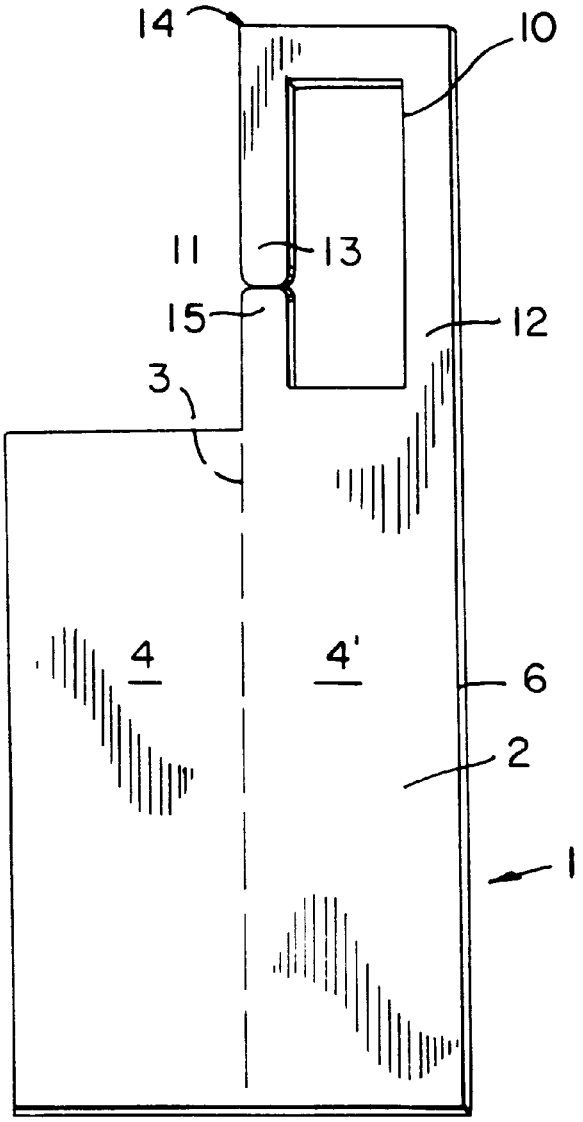
FIG. 1 is a schematic plan view of a blank for a first embodiment of entry card holder according to the invention.
Figure 3:
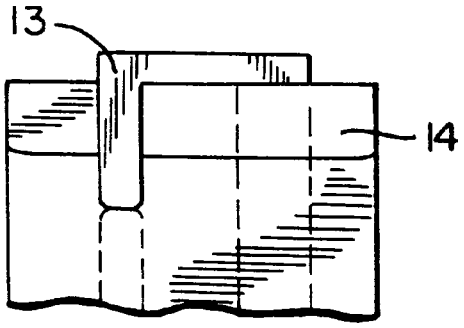
FIG. 3 is a fragmentary plan view showing the holder clipped to the pocket of a user.

The entry card holder has a substantially flat unitary body formed from a blank 1 stamped from 20–30 mil plastic sheet having a pocket precursor formed from a rectangular portion 2 which is heat folded along a fold line 3 slightly offset from a longitudinal centerline into substantially flat condition to provide two, overlying panel portions 4,4' with engaging surfaces defining between them a substantially flat, sleeve-form, card clasping pocket 5 open to all three free edges 6, 7, and 8, for releasable sliding receipt of a type of transit entry card known as a METROCARD SM A known form of hook structure comprising a slit, rectangular eye 10 is provided in a longitudinal extension 12 of a rear panel portion 4' and has an access slit 11 provided in a longitudinal side adjacent the fold 3', dividing the side into a relatively long, returned arm portion providing a free end 13 of a hook clip 14 and a land formed as a relatively short arm portion 15 extending away from panel portion 4' to adjacent the free end 13 providing an anti-snagging, hook guard and closure. The provision of the hooked clip 14 enables the holder carrying the card to be deformed resiliently out of the plane of the panel portion and readily secured to the interior (or exterior) of a top edge of person's pocket, as shown in FIG. 3, and easily released when required for use. As the free end of the hook is adjacent the hinged side of the pocket, the hook opens away from the entry card, obviating or minimizing any risk of the hooking action or hook manipulation dislodging the entry card.

The slight offset in the major free edges facilitates insertion of the entry card into the holder as the lower, exposed edge portion of the panel portion 4' provides a card edge guiding lip 18.

Figure 4:
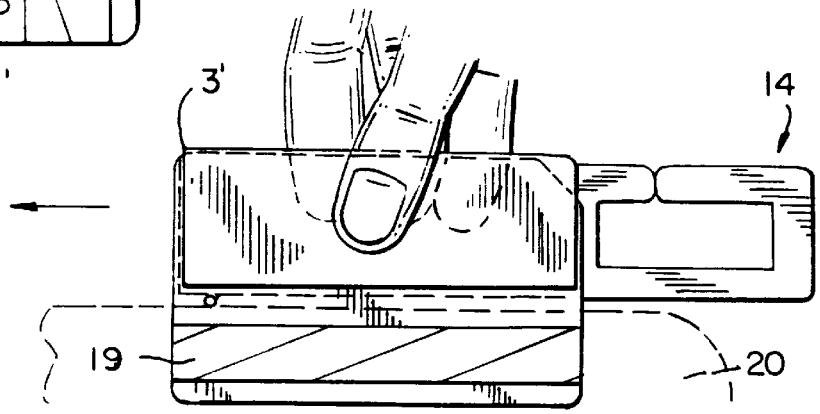
FIG. 4 is a similar view to FIG. 2 showing the holder retaining a mass transit entry card during use; and, FIG. 5 is a fragmentary plan view of a second embodiment of card holder showing an alternative form of securing means.

As shown in FIG. 4, in use, the transit entry card 16 is clasped by the resiliency of the plastic in the card receiving portion of the holder with the free longitudinal edge portion carrying the machine readable magnetically encoded strip 19 protruding therefrom so as to be clear of the holder and completely exposed for unobstructed sliding (swiping) movement along the card receiving slot of a reader, indicated in broken lines. During swiping, the card receiving portion is gripped between the user's fingers and thumb which remain clear of the slot 20 while ensuring that the card is retained firmly in the holder.

Figure 5:
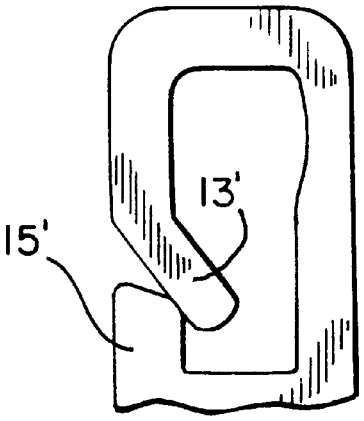
Figure 2:
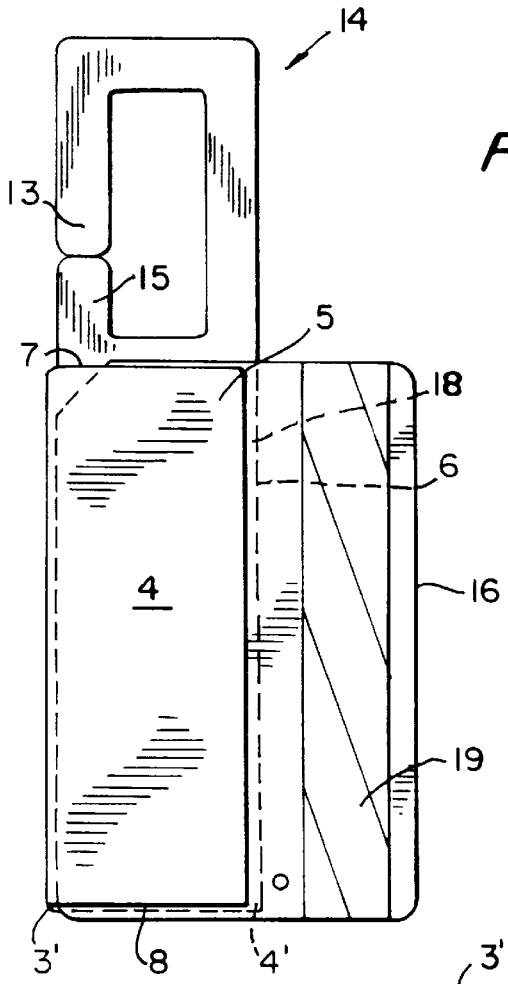
FIG. 2 is a schematic plan view of the first embodiment formed from the blank, retaining a mass transit entry card.

In the second embodiment shown in FIG. 5, the free end 13' of the hook portion returns inwards or behind the arm portion 15' improving security as the arm portion 15' both guards the free end and provides a stop to assist in preventing outward deformation of the free end 13' when the hook is under load while remaining in the plane of the material, for example when used as an eye receiving a strap of a bag or pocketbook to secure the card holder thereto.

It will be appreciated that, whilst adapted specifically for use with a METROCARD $_{SM}$, a card holder according to the invention could be used with bank credit card, telephone and even hotel entry cards which require access to an encoded portion for reading.

As the card holder can be manufactured at extremely low cost it is suitable for distribution free of charge as a promotional item displaying advertising marked, for example, on the outer faces of the pocket forming panels.

The approximate maximum dimensions overall dimensions of the card holder in inches are 1⅛×5½ with the first panel portion being 3½×1, with the second panel portion provides a lip of ⅛ inch.

What is claimed is:

1. A card holder for a card having an edge portion encoded with machine readable information comprising a card receiving pocket for retaining the card with the encoded edge portion thereof protruding out of the pocket clear of the holder, thereby exposed, for free insertion in a slot of a reading head of a card reader by a person gripping the card holder, enabling the card to be machine read without removal from the card holder and, releasable securing means comprising one of a hook and eye attached to the pocket for securing the card holder retaining the card to one of a user's pocket and bag strap, wherein the card receiving pocket comprises two rectangular panel portions having adjacent longitudinally extending sides joined together at an edge so that the panel portions extend in parallel, overlying relation for retaining a card between them with the encoded edge portion protruding transversely out of the pocket remote from said sides, wherein the securing means is located spaced apart from said edge.

2. A card holder for a card having an edge portion encoded with machine readable information comprising a card receiving pocket for retaining the card with the encoded edge portion thereof protruding out of the pocket clear of the holder, thereby exposed, for free insertion in a slot of a reading head of a card reader by a person gripping the card holder, enabling the card to be machine read without removal from the card holder and, releasable securing means attached to the pocket for securing the card holder retaining the card to one of a user's pocket and bag strap, wherein the card receiving pocket comprises two rectangular panel portions having adjacent longitudinally extending side edges joined together so that the panel portions extend in parallel, overlying relation for retaining a card between them with the encoded edge portion protruding transversely out of a side of the pocket remote from said side edges and, wherein the releasable securing means comprises a hook which extends in substantially coplanar relation from a longitudinal end of one of the panel portions and the two panel portions are formed by folding a blank about a longitudinal axis providing a hinge by which the adjacent side edges are joined together.

3. A card holder according to claim 2 wherein the hook opens away from a side which is remote from said hinge.

4. A card holder according to claim 2 wherein the two panel portions are joined together only by the hinge and so that the two panel portions can clasp the card between them.

5. A card holder according to claim 3 including a land which extends from said longitudinal end of the panel portion and wherein said hook has a returned free end extending inward behind the land, the land forming a stop for preventing overstress of the hook.

6. A card holder according to claim 2 wherein one of the panel portions has a width greater than a width of the other panel portion providing a card guiding lip facilitating insertion of a card between free side edges of the panel portions opposite the joined side edges.

7. A card holder according to claim 3 wherein one of the panel portions has a width greater than a width of the other panel portion providing a card guiding lip facilitating insertion of a card between free side edges of the panel portions opposite the joined side edges.

8. A card holder according to claim 4 wherein one of the panel portions has a width greater than a width of the other panel portion providing a card guiding lip facilitating insertion of a card between free side edges of the panel portions opposite the joined side edges.

9. A combination of a card holder and a mass transit entry card having a longitudinal edge portion encoded with machine readable information, the card holder comprising a card receiving pocket for retaining the card with the encoded edge portion thereof protruding out of the pocket clear of the holder, thereby exposed, for free insertion in a slot of a reading head of a card reader by a person gripping the card holder, enabling the card to be machine read without removal from the card holder and, releasable securing means attached to the pocket for securing the card holder retaining the card to one of a user's pocket and bag strap.

10. A combination according to claim 9 wherein the card receiving pocket comprises two rectangular panel portions having adjacent longitudinally extending side edges joined together so that the panel portions extend in parallel, overlying relation for retaining a card between them with the encoded edge portion protruding transversely out of a side of the pocket remote from said side edge.

11. A combination according to claim 10 wherein the releasable securing means comprises a hook which extends in substantially coplanar relation from a longitudinal end of one of the panel portions and the two panel portions are formed by folding a blank about a longitudinal axis providing a hinge by which the adjacent side edges are joined together.

12. A combination according to claim 11 wherein the hook opens away from a side which is remote from said hinge.

13. A combination according to claim 12 wherein the two panel portions are joined together only by the hinge and clasp the card between them.

14. A combination according to claim 13 wherein said hook has a returned free end extending inward, behind a land which extends from said longitude end of the panel portion, forming a stop, for preventing overstress of the hook.

15. A combination according to claim 12 wherein one of the panel portions has a width greater than a width of the other panel portion providing a card guiding lip facilitating insertion of a card between free side edges of the panel portions opposite the joined side edges.

16. A combination according to claim 13 wherein one of the panel portions has a width greater than a width of the other panel portion providing a card guiding lip facilitating insertion of a card between free side edges of the panel portions opposite the joined side edges.

17. A combination according to claim 14 wherein one of the panel portions has a width greater than a width of the other panel portion providing a card guiding lip facilitating insertion of a card between free side edges of the panel portions opposite the joined side edges.

18. A card holder for a card having one longitudinal edge portion encoded with machine readable information, the card holder comprising a longitudinally hinged, clasp portion for gripping receipt of another, opposite longitudinal edge portion of the card adjacent a hinge with the one longitudinal edge portion protruding transversely out of the clasp portion remote from the hinge and, releasable securing means attached to the clasp portion for securing the card holder clasping the card to one of a user's pocket and bag strap, the releasable securing means being formed as a longitudinal extension of the clasp portion so that the one edge portion remains exposed for machine reading by longitudinal sliding movement along a slot of a card reading head in a swiping action.

* * * * *